US006986678B1

(12) United States Patent
Di-Nardo et al.

(10) Patent No.: US 6,986,678 B1
(45) Date of Patent: Jan. 17, 2006

(54) LOCKABLE ELECTRICAL CONNECTOR

(76) Inventors: Jason Di-Nardo, 87 Albion Way, Verwood, Dorset (GB) BH31-7LS; Jayne Lynch, 87 Albion Way, Verwood, Dorset (GB) BH31-7LS ( * ) Notice: Subject to any disclaimer, the term of this patent is extended or adjusted under 35 U.S.C. 154(b) by 0 days.

(21) Appl. No.: 10/890,925

(22) Filed: Jul. 15, 2004

(51) Int. Cl.
*H01R 13/62* (2006.01)
*H01R 13/64* (2006.01)

(52) U.S. Cl. ..... 439/372; 439/953

(58) Field of Classification Search ..... 439/372, 439/346, 953, 102, 131, 304, 270, 139, 353
See application file for complete search history.

(56) References Cited

U.S. PATENT DOCUMENTS 2,885,650 A * 5/1959 Miller et al. ..... 439/270
4,080,029 A 3/1978 St. Fort ..... 439/131
4,467,398 A 8/1984 Weber ..... 361/331
4,479,688 A 10/1984 Jennings
4,504,103 A * 3/1985 Woedl ..... 439/131
D310,063 S 8/1990 Cheng ..... D13/142
5,061,199 A 10/1991 McClead ..... 439/304
5,069,634 A * 12/1991 Chiarolanzio ..... 439/353
5,286,213 A * 2/1994 Altergott et al. ..... 439/139
5,941,724 A * 8/1999 Reed ..... 439/346
5,973,414 A 10/1999 Båberg ..... 307/116
5,989,052 A 11/1999 Fields et al. ..... 439/373

* cited by examiner

*Primary Examiner*—Javaid H. Nasri
(74) *Attorney, Agent, or Firm*—Donald R. Schoonover

(57) ABSTRACT

An electrical connector includes a male element which has a spring-loaded lock element and a female wall socket that has a lock element-accommodating opening defined therein. The spring-loaded lock element is operated by means of a screw driver-accommodating element located on the male element.

1 Claim, 1 Drawing Sheet

LOCKABLE ELECTRICAL CONNECTOR

BACKGROUND OF THE INVENTION

1. Field of the Invention

The present invention relates to the general art of electrical connectors, and to the particular field of locks for electrical connectors.

2. Discussion of the Related Art

Many parents try to child-proof their homes or residences. Child-proofing often includes erecting gates, locking cabinet doors, and locking drawers. All of these steps are intended to prevent a child from injuring himself.

Many children are injured because they came into contact with electricity. This situation often occurs when a child places his or her finger or an object into an electrical outlet. For this reason, many parents close electrical outlets by placing plastic covers over the outlets or the like. This is effective. However, there is yet another way children can come into contact with electricity. If an electrical product is plugged into an outlet and that plug is partially removed, an open electrical connection is established and anyone contacting that open connection is in danger of receiving a serious electrical shock.

Therefore, there is a need for an electrical connector unit which can prevent an electrical plug from being unintentionally and partially removed from a socket.

Even though it is important to prevent an electrical plug from being inadvertently removed from a socket, it is also necessary to make it expeditious and easy to lock and unlock the plug and socket connection. If it is too difficult or cumbersome to lock and unlock the plug and the socket, the locking feature may not be used.

Therefore, there is a need for an electrical connector unit that can be locked and unlocked in an expeditious manner.

PRINCIPAL OBJECTS OF THE INVENTION

It is a main object of the present invention to provide an electrical connector unit which can prevent an electrical plug from being unintentionally and partially removed from a socket.

It is another object of the present invention to provide an electrical connector unit that can be locked and unlocked in an expeditious manner.

SUMMARY OF THE INVENTION

These, and other, objects are achieved by a locking unit for an electrical plug and socket combination which includes a prong on the male portion of the unit and a slot defined on the socket portion of the unit. The prong is T-shaped and is rotatably mounted on the male portion to move between a locking orientation and an unlocking orientation. When the prong is in the unlocking orientation, it can be moved through the slot defined on the socket portion, and once through the slot, the prong can be rotated into a locking orientation. When the prong is in the locking orientation, it cannot pass through the slot so the male portion will be locked to the socket portion. The male portion has electrical prongs and the socket has electrical prong-accommodating slots. When the male portion is locked to the socket, the electrical prongs are locked in the electrical prong-accommodating slots.

Using the locking unit embodying the present invention will permit a male portion of a plug unit to be easily and quickly locked to the socket portion of a plug unit so the plug unit is securely locked to the socket portion. However, the male portion can be quickly and easily unlocked and removed from the socket portion so use of the locking feature will be easy and expeditious.

BRIEF DESCRIPTION OF THE DRAWING FIGURES

DETAILED DESCRIPTION OF THE PREFERRED EMBODIMENT

Figure 2:
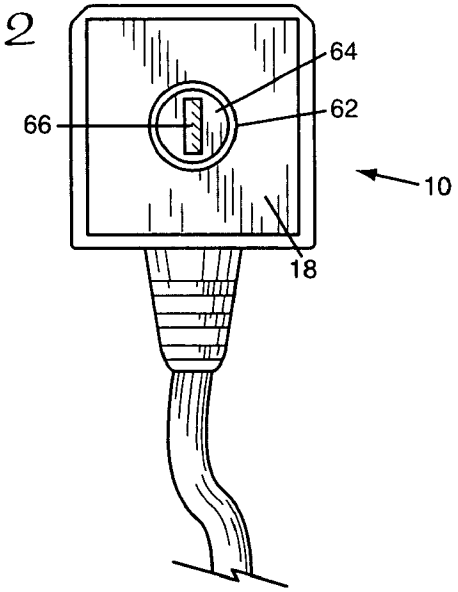
FIG. 2 is a rear elevational view of the electrical plug embodying the present invention.

Other objects, features and advantages of the invention will become apparent from a consideration of the following detailed description and the accompanying drawings.

Referring to the Figures, it can be understood that the present invention is embodied in an electrical connector unit 10 that will be easy and expeditious to use and will securely lock a plug into a socket, such as a wall outlet.

The electrical connector unit 10 embodying the present invention comprises a male element 12 such as might be associated with an electrically powered element.

Male element 12 includes a housing 14 having a first surface 16, which is a front surface when male element 12 is in use, and a second surface 18, which is a rear surface when male element 12 is in use.

A grounding prong 20 extends outwardly from the first surface 16, and two electrical contact prongs 22 and 24 extend outwardly from first surface 16.

An electrical cord 26 is electrically connected to electrical contact prongs 22 and 24 in the manner common to such plugs.

The unit 10 embodying the present invention further includes a lock element prong-accommodating orifice 30 defined in first surface 16.

A lock element 36 includes a prong 38 which extends outwardly from first surface 16 through lock element-accommodating orifice 30. Prong 38 includes a body 40, which has a proximal end 42 located inside housing 14, and a distal end 44, which is located outside housing 14. A head element 50 is located on body 40. Head element 50 is oriented at a right angle to body 40 and is spaced apart from first surface 16. Head element 50 is oriented with respect to body 40 to define a T-shape.

A prong-operating system 60 is located in housing 14 and includes a barrel 62 rotatably mounted on housing 14. Barrel 62 has an operating surface 64 located on second surface 18 of housing 14. A slot 66 is defined in operating surface 64, and is adapted to accommodate a blade of a screwdriver or the like.

Barrel 62 has a second surface 68 connected to proximal end 42 of prong 40 in housing 14.

Barrel 62 further includes a longitudinal axis 72 which extends between operating surface 64 and second surface 68 of barrel 62. Longitudinal axis 72 of barrel 62 also extends between first surface 16 of housing 14 and second surface 18 of housing 14.

Figure 4:
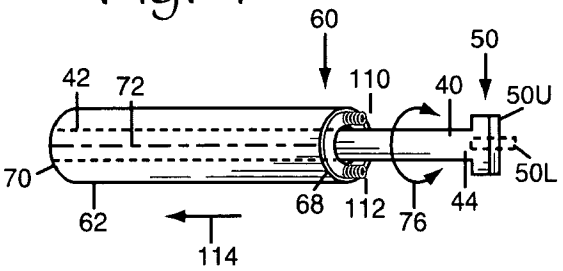
FIG. 4 is a perspective view of a barrel portion of a lock element which is included in the electrical plug embodying the present invention.
Figure 1:
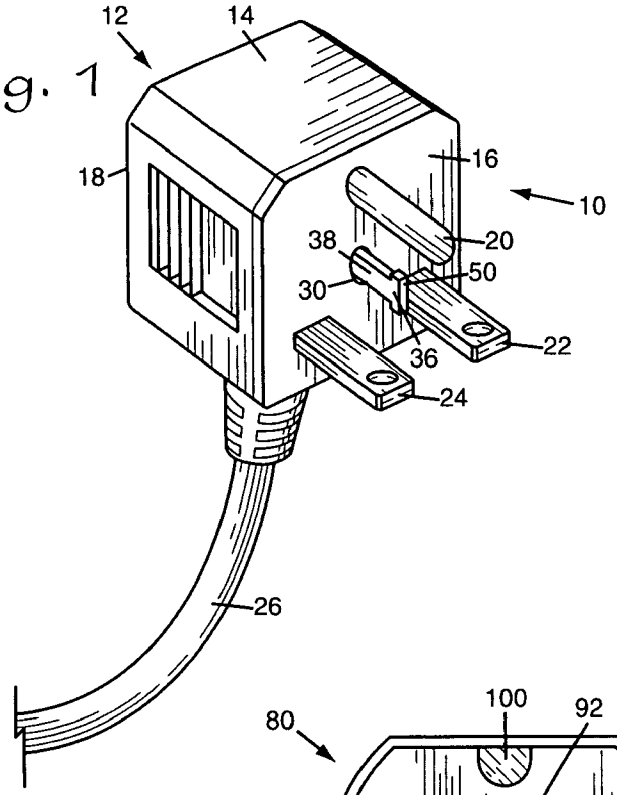
FIG. 1 is a perspective view of an electrical plug having a lock element embodying the present invention.

Barrel 62 is mounted in housing 14 for rotation about longitudinal axis 72 as indicated by double-headed arrow 76 in FIG. 4. Prong 38 rotates with barrel 62 so head element 50 moves between an unlocking orientation indicated in FIG. 4 by solid lines 50U and a locking orientation indicated in FIG. 4 by dotted lines 50L.

Figure 3:
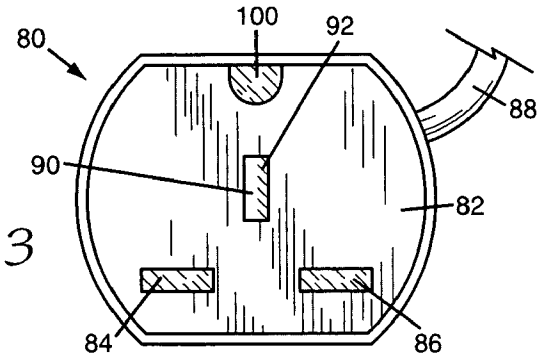
FIG. 3 is a wall outlet socket which is used in conjunction with the electrical plug shown in FIG. 1.

A female receptacle 80 is shown in FIG. 3 and can be mounted on a wall or the like.

Female receptacle or socket element 80 includes a face plate 82 and two electrical prong-accommodating slots 84 and 86 defined through the face plate 82. An electrical connection 88 is electrically connected to electrical prong-accommodating slots 84 and 86.

A lock element-accommodating receptacle 90 is defined in the face plate 82. Lock element-accommodating receptacle 90 includes a slot 92 defined through face plate 82. Slot 92 is sized and oriented to accommodate head element 50 of prong 38 when the head element 50 of prong 40 is in unlocking orientation 50U to permit head element 50 to move through slot 92. Slot 92 is also sized and oriented to prevent head element 50 from passing through slot 92 when the head element 50 of prong 40 is in locking orientation 50L.

Slot 92 defined through face plate 82 is located adjacent to electrical prong-accommodating slots 84 and 86 so that when prong 40 is accommodated through slot 92, electrical contact prongs 22 and 24 are accommodated in electrical prong-accommodating slots 84 and 86.

A grounding prong-accommodating orifice 100 is located on face plate 82 and accommodates grounding prong 20 of male element 12 for the usual purpose of grounding the connection.

As shown in FIG. 4, springs 110 and 112 can be interposed between second surface 68 of barrel 62 and first surface 16 of housing 14 to bias the barrel 62 in direction 114 towards second surface 18. Operating surface 64 is positioned inside housing 14 and abuts the inside of surface 18 to prevent barrel 62 from moving out of housing 14 under the influence of springs 110 and 112. Operation of the barrel 62 will require a user to press inwardly on operating surface 64 via slot 66 to move prong 40 through slot 92. Once pressure is released, springs 110 and 112 draw head element 50 back against face plate 82 so head element 50 abuts face plate 82 adjacent to slot 92. This abutting contact will ensure stable locking of male element 12 to socket element 80.

Operation of the electrical connector unit can be understood by those skilled in the art based on the teaching of the present disclosure and thus will not be described in detail. Male element 12 is oriented adjacent to socket element 80 and barrel 62 is rotated by means of a screwdriver blade being inserted into slot 66 and rotated so head element 50 is in unlocking orientation 50U. Male element 12 is then moved toward socket element 80 so that electrical prongs 22 and 24, and grounding prong 20, are moved into prong-accommodating orifices 84, 86 and 100. After the prongs are securely in the prong-accommodating orifices and prong 40 extends through slot 92, barrel 62 is again rotated so head element 50 moves into locking orientation 50L and abuts face plate 82 adjacent to slot 92. The male element 12 is then locked to the face plate 82 and the prongs cannot be moved out of the prong-accommodating holes. The plug is thus locked to the socket. Release of the plug from the socket is the reverse of the aforedescribed process where head element 50 is rotated into unlocking orientation 50U, and male element 12 is pulled away from socket element 80.

It is understood that while certain forms of the present invention have been illustrated and described herein, it is not to be limited to the specific forms or arrangements of parts described and shown.

What is needed and desired to be covered by Letters Patent is as follows:

1. An electrical connector unit comprising:

(a) a male element which includes (1) a housing having a first surface that is front surface when said male element is in use, a second surface that is a rear surface when said male element is in use, (2) a grounding prong which extends outwardly from the first surface, (3) two electrical contact prongs which extend outwardly from the first surface, (4) an electrical cord electrically connected to the electrical contact prongs, (5) a lock element prong-accommodating orifice defined in the first surface of the housing, and (6) a lock element which includes (A) a prong which extends through the lock element-accommodating orifice outwardly from the first surface, the prong including (i) a body having a proximal end located inside the housing and a distal end located outside the housing, (ii) a head element on the body, the head element being oriented at a right angle to the body of the prong and being spaced apart from the first surface of the housing, and (iii) the head element being oriented with respect to the body of the prong to define a T-shape, and (B) a prong-operating system in the housing and which includes (i) a barrel rotatably mounted on the housing and having an operating surface located on the second surface of the housing of the male element, (ii) a slot defined in the operating surface, (iii) the barrel having a second surface connected to the proximal end of the prong in the housing, and (iv) a longitudinal axis which extends between the operating surface and the second surface of the barrel, the longitudinal axis of the barrel extending between the first surface of the housing of the male element and the second surface of the housing of the male element, (v) the barrel being mounted in the housing of the male element for rotation about the longitudinal axis of the barrel, the prong rotating with the barrel so the head element of the prong moves between an unlocking orientation and a locking orientation; and (b) a female receptacle which includes (1) a face plate, (2) two electrical prong-accommodating slots defined through the face plate, (3) an electrical connection electrically connected to the electrical prong-accommodating slots, (4) a lock element-accommodating receptacle in the face plate, the lock element-accommodating receptacle including a slot defined through the face plate, the slot being sized and oriented to accommodate the head element of the prong when the head element of the prong is in the unlocking orientation to permit the head element to move through the slot defined through the face plate, the slot being sized and oriented to prevent the head element of the prong from passing through the slot when the head element of the prong is in the locking orientation, and (5) the slot defined through the face plate being located adjacent to the electrical prong-accommodating slots so that when the prong is accommodated through the slot the electrical prongs are accommodated in the electrical prong-accommodating slots; and (c) a spring element on the barrel of the prong operating system, the spring element being located to be interposed between the barrel and the first surface of the housing of said male element to bias the barrel toward the second surface of the housing of said male element.

* * * * *